United States Patent [19]

Baravaglio

[11] Patent Number: 4,512,585

[45] Date of Patent: Apr. 23, 1985

[54] BULLET TRAP FOR A SHOOTING STAND

[76] Inventor: Marie E. Baravaglio, 5, rue des Lacs, 91350 Grigny 2, France

[21] Appl. No.: 594,359

[22] Filed: Mar. 28, 1984

[30] Foreign Application Priority Data

Apr. 8, 1983 [FR] France ..... 83 06395

[51] Int. Cl.[3] ..... F41J 1/12

[52] U.S. Cl. ..... 273/410

[58] Field of Search ..... 273/404, 410

[56] References Cited

U.S. PATENT DOCUMENTS

| | | | |
|---|---|---|---|
| 385,546 | 7/1888 | Decumbus | 273/404 |
| 2,201,527 | 5/1940 | Freeman | 273/404 X |
| 2,535,280 | 12/1950 | Gartrell | 273/404 |
| 3,319,960 | 5/1967 | Wilcox | 273/404 |
| 3,720,411 | 3/1973 | De Vogelaere | 273/404 |

FOREIGN PATENT DOCUMENTS

| | | | |
|---|---|---|---|
| 858951 | 12/1952 | Fed. Rep. of Germany | 273/404 |
| 2847742 | 1/1980 | Fed. Rep. of Germany | 273/404 |
| 22013 | of 1893 | United Kingdom | 273/410 |

*Primary Examiner*—Paul E. Shapiro

*Attorney, Agent, or Firm*—Ratner & Prestia

[57] ABSTRACT

A bullet trap is provided comprising a succession of metal sheets slanted alternately forwardly and rearwardly and forming a succession of dihedrons with an angle at the apex less than 60°. The metal sheets are joined together two by two at their front end and are close to each other two by two at their rear end, while being separated by a space forming a passage for the bullets. The upper metal sheets are extended rearwardly, beyond the passage, by a curved portion forming a deflector deflecting the bullets against the rear face of the lower metal sheets.

5 Claims, 3 Drawing Figures

BULLET TRAP FOR A SHOOTING STAND

BACKGROUND OF THE INVENTION

1. Field of the Invention

The present invention relates to bullet traps, used in firing stands or rifle ranges and intended for retaining the bullets after the targets while avoiding the return of splinters. The invention applies to the construction of bullet traps made more especially from a lead alloy.

2. Description of the Prior Art

Devices are already known for fulfilling these functions but whose efficiency is sometimes defective to the extent that projections of splinters fly back in the direction of the shooter. Thus it is the case for the devices described in the following patents:

the device of U.S. Pat. No. 2,013,133 comprises a succession of 90° dihedrons with vertical edge with a rear passage extended by a spiral deflector;

in the U.S. Pat. No. 2,201,527, an upper metal sheet, at 40°, and a lower metal sheet, at 15°, form a disymmetric dihedron with a rear passage extended by a deflector producing a deflection of about 150°, projecting the bullet towards a second deflector at about 150° which directs it towards a container;

the U.S. Pat. No. Des. 3,104,127 describes a deflection device in which the two walls of the disymmetrical dihedron are extended rearwardly into a curved duct projecting the bullet against an auxiliary wall;

the bullet trap of U.S. Pat. No. 3,701,532 comprises a dihedron formed from an assembly of three plates with different angles leading to a retarding chamber comprising two deflectors producing a deflection of about 150°;

in the U.S. Pat. No. 2,772,092 several parallel slanting plates deflect the bullets against a single rear plate and a lower retarding chamber has two deflectors. Such an arrangement requires a substantially larger area of metal plate.

SUMMARY OF THE INVENTION

The aim of the present invention is to avoid the disadvantages of the known devices by proposing a new type of bullet trap ensuring that the bullets are totally retained, or at least having a very low probability of back scattering of splinters, said splinters having a minimum energy limiting their range to a distance close to a meter.

Another object of the present invention is to propose such a device avoiding the premature wear by bullets passing the same portion of the device too frequently.

Another object of the invention is to propose a device in which the kinetic energy of the bullet is cancelled out by several shocks or successive deflections, so that slowing down is progressive and avoids the formation of splinters and the premature wear of the parts of the device.

According to another object of the invention, the device comprises interchangeable parts able to be changed independently of each other.

To attain these objects as well as others, the present invention provides a bullet trap constructed by disposing a succession of metal plates slanted alternately forwardly and rearwardly and forming a succession of dihedrons with an angle at the apex less than 60° and with a bisecting plane parallel to the mean firing direction; the metal plates are joined together two by two at their front end, and are close together two by two at their rear end while being separated by a space forming a passage for the bullets; a first metal sheet out of the two is extended rearwardly, beyond the passage, by a portion curved into a semi cylinder forming a deflector, a second metal sheet being interrupted at the level of the passage. The applicant has discovered that this arrangement presents the advantage of avoiding any back scattering of large splinters, the incoming bullet sliding over the first metal sheet and being introduced into the passage and deflected by the deflector, without premature wear of this deflector, before undergoing any damage likely to produce splinters.

According to another feature of the invention, the deflector deflects the bullets and reverses their direction of travel so as to throw them back against the rear face of the second sheet not provided with a deflector. Thus a second shock is produced participating in slowing down the bullet, this second shock being only a deflection which also avoids the premature formation of splinters.

According to another feature of the invention, angle irons are provided on the rear face of the second metal sheet parallel to the apex of the dihedrons and disposed after the impact line of the bullets on the rear face of the metal sheets. The angle irons deflect the bullets sharply towards the rear face of the first metal sheets, thus causing a third shock which progressively reduces its kinetic energy.

BRIEF DESCRIPTION OF THE DRAWINGS

Other features and advantages of the present invention will be clear from the following description of particular embodiments, made with reference to the accompanying Figures in which.

DESCRIPTION OF THE PREFERRED EMBODIMENT

Figure 1:
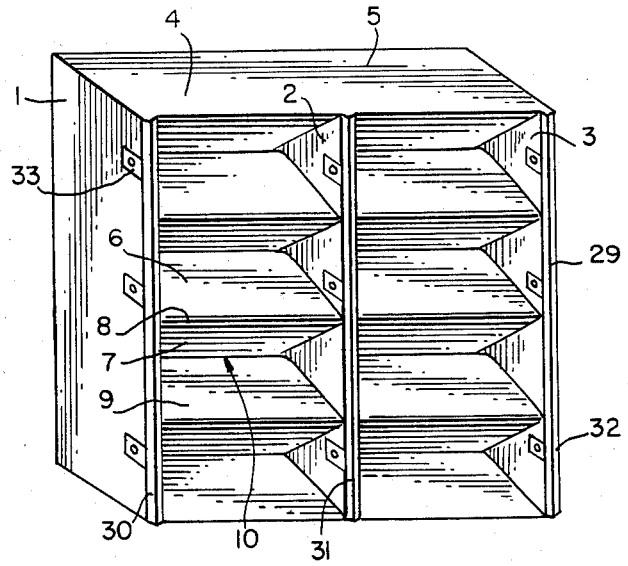
FIG. 1 shows a perspective view of a bullet trap according to the present invention in an embodiment having horizontal dihedrons and comprising two modules.

In the embodiment shown in FIG. 1, the bullet trap comprises vertical end walls 1, 2 and 3, separating the device into two compartments or modules 4 and 5. Each module comprises a succession of metal plates slanted alternately towards the front and towards the rear and forming a succession of dihedrons with an angle less than 60°, as shown in FIG. 1 seen from the front. The term metal sheet will be understood as designating a plate made from a resistant material, for example from steel.

Figure 2:
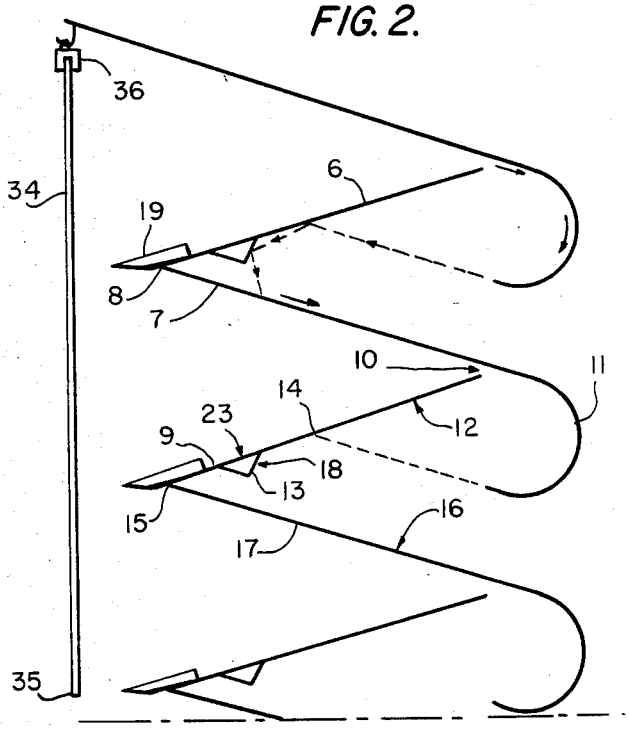
FIG. 2 shows a schematical longitudinal sectional view of the bullet trap of FIG. 1.

The metal sheets are joined together two by two, for example sheets 6 and 7, at their front end 8 forming the apex of the dihedron. The metal sheets are close together two by two at their rear end, for example sheets 7 and 9, while being separated by a space 10 forming a passage for the bullets. At the rear of passage 10, one metal sheet out of two is extended by a curved portion 11 forming the deflector 11, the second sheet 9 being interrupted at the level of passage 10. In the embodiment such as shown in FIG. 1, in which the apices 8 of the dihedrons are horizontal, it is necessary to dispose deflectors 11 in the extension of the first metal sheets 7 disposed above the corresponding metal sheets 9, as shown in FIG. 2. The deflector 11 deflects the bullets downwards, so that they do not tend to pass again through passage 10.

In the embodiment shown in the Figures, deflector 11 is a cylindrical metal sheet with axis parallel to the apex 8 of the dihedrons, connected to the first metal sheet 7 along its tangent. Preferably, deflector 11 is a semi cylindrical surface, throwing the bullet back against the rear face 12 of the second metal sheet 9.

The slant of metal sheets 7 and 9 is chosen so that the bisecting plane of the dihedrons is parallel to the mean firing direction. Furthermore, the angle of the dihedrons will be chosen less than 60°, which prevents the bullets from bouncing on the metal sheets and the formation of splinters. According to this arrangement, the bullets slide either over the first metal sheets 7, or over the second metal sheets 9, as far as passage 10, after which they continue their travel while sliding over the first metal sheets 7 and deflector 11.

On the rear face 12 of the second metal sheets 9, transverse angle irons 13 are disposed parallel to the apex 8 of the dihedrons. The angle irons 13 are disposed between the impact line 14 of the bullets on the rear face 12 of the second metal sheet 9 and the apex of the dihedron 15, so that the bullet, after striking the rear face 12, strikes the angle iron so as to be deflected again against the rear face 16 of the corresponding first metal sheet 17. The slant of the active face 18 of the angle iron 13 with respect to the second metal sheet 9 will be between 40° and 50°, preferably 45°, so as to ensure correct deflection of the bullet without however breaking it up into splinters. The applicant has discovered that the successive deflections thus produced are sufficient to cancel out the kinetic energy of the bullet, so that it then slides over the rear faces 16 of the first metal sheets and falls at the rear of the device.

The apices 8 of the dihedrons are protected by an added part 19 in the form of a knife intended to cut the bullets whose path passes through this line. Similarly, the front edges 29 of the end walls 1, 2 and 3 are covered with an added upright, respectively 30, 31 and 32, comprising a front edge shaped so as to cut the bullets and rear lugs such as lug 33, overlaying laterally the end walls of two adjacent modules. Lugs 33 are fixed to the walls by bolting. The added uprights thus provide simultaneously protection of the front edges 29, shattering of possible bullets without back scattering of splinters, and the assembly of successive modules 4, 5.

Figure 3:
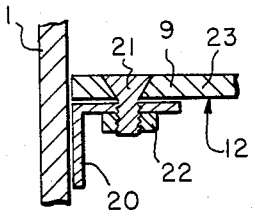
FIG. 3 shows a partial view illustrating the assembly of the metal sheets on the end walls.

The assembly of the device may be achieved in the following way: on a rigid frame formed by the end walls 1, 2 and 3, lateral angle irons are disposed slanting according to the desired slant for the metal sheets and, as shown in FIG. 3, the metal sheets are fixed such as metal sheet 9 on the angle irons 20 by means of bolts 21 with smooth countersunk head and nuts 22. The bolthead is disposed in a corresponding housing from the front face 23 of metal sheet 9, the angle iron 20 being applied against the rear face 12 of the metal sheet. The angle iron 20 is firmly secured to the corresponding end face 1 by any known means, such as bolts, rivets, welding. The metal sheets are thus interchangeable and may be taken down by removing the bolts 21 and nuts 22, which are accessible from the rear of the device.

In the embodiment which has just been described, the dihedrons have a horizontal apex. The device may however be placed in such a position that the apices of the dihedrons are vertical, without requiring modifications.

Similarly, a device may be provided comprising two modules as shown in FIG. 1 or a single module, or more than two modules, depending on the size of the bullet trap to be constructed.

The applicant has discovered that the bullets lose their energy completely by deflection and successive deviations on the metal sheets and deflectors 11. It is not necessary to provide at the rear of the device additional means for stopping the bullets or the splinters. Thus, the device may be placed against a wall and, for facilitating access to the rear of the device for cleaning and for removing the bullets and splinters, the assembly may be mounted on wheels or rollers.

The preceding arrangements completely avoid the production and the back scattering of large sized splinters. It is however preferable to eliminate small sized splinters also. According to an important improvement, the back scattering of small sized splinters is eliminated by disposing, in front of the metal sheet dihedrons, i.e. between the metal sheet trap and the marksman, a wall which the incident bullet may pass through but which retains the splinters which may be possibly back scattered. For that, an interchangeable strip 34 made from a thick plastic material, preferably of a thickness between 0.5 and a few millimeters, for instance a polyvinyl chloride strip 4 millimeters thick, is suspended while leaving it free at its sides and at its lower end 35, held at its upper end by clamping between rods 36 hooked onto the upper metal sheet dihedron. Several parallel strips may be provided covering the whole front surface of the trap. For example, a module 4, may comprise three strips, a central strip and two lateral strips. The most efficient strips are the lateral strips. It is apparent that the fact of leaving the strips free along three sides substantially increases their life span.

The present invention is not limited to the embodiments which have been explicitly described, but it includes the different variations and generalizations thereof contained within the scope of the following claims.

What is claimed is:

1. A bullet trap for a firing stand, comprising successions of metal sheets slanted alternately to the front and to the rear and forming a succession of dihedrons, metal sheets joined together two by two at their front end and being close to each other two by two at their rear end while being separated by a space forming a passage for the bullets, a first metal sheet out of two being extended rearwardly, beyond the passage, by a curved portion forming a deflector, the second metal sheet being interrupted at the level of the passage, the angle at the apex of the dihedrons being less than 60°, the bisecting plane of the dihedrons being parallel to the mean shooting direction and the deflector being formed by a semi cylinder connected to the corresponding first metal sheet along its tangent for deflecting the bullets and reversing their direction of travel while throwing them back against the rear face of the second metal sheet not provided with deflectors, wherein angle irons are firmly secured to the rear face of the second metal sheets parallel to the apex of the dihedrons and disposed after the line of impact of the bullets on the rear face of the metal sheets, so as to form a deflector throwing the bullets back onto the rear face of the first metal sheets.

2. The bullet trap as claimed in claim 1, wherein the slant of the active face of said angle iron with respect to said second metal sheet is between 40° and 50°.

3. The bullet trap as claimed in claim 1, further comprising end walls perpendicular to the metal sheets and on which are secured the metal sheets.

4. The bullet trap as claimed in claim 3, wherein the front edges of said end walls are covered by an added upright comprising a front edge shaped so as to cut the bullets and rear lugs partially overlying the end walls of two adjacent modules to which they are fixed by bolting, the added upright providing simultaneously protection of the front edges and assembly of the successive modules.

5. The bullet trap as claimed in claim 1, wherein the apices of the dihedrons are protected by added parts in the from of knives for cutting the bullets.

* * * * *